US006360567B1

(12) United States Patent
Lu

(10) Patent No.: US 6,360,567 B1
(45) Date of Patent: Mar. 26, 2002

(54) WASHING MACHINE ADAPTED TO BE SUPPLIED WITH DIFFERENT LEVELS OF WATER DURING A WASHING OPERATION

(76) Inventor: Maw-Wen Lu, No. 2-23, Alley 7, Lane 13, Sec. 1, Nanking E. Rd., Taipei City (TW)

( * ) Notice: Subject to any disclaimer, the term of this patent is extended or adjusted under 35 U.S.C. 154(b) by 0 days.

(21) Appl. No.: 09/528,430

(22) Filed: Mar. 17, 2000

(30) Foreign Application Priority Data

Apr. 8, 1999 (TW) ..... 088205397

(51) Int. Cl.[7] ..... D06F 39/08
(52) U.S. Cl. ..... 68/12.05; 68/12.21
(58) Field of Search ..... 68/12.01, 12.05, 68/12.21

(56) References Cited

U.S. PATENT DOCUMENTS 3,362,197 A * 1/1968 Reed
4,368,627 A * 1/1983 Bode, Sr. et al.
4,480,449 A * 11/1984 Getz
4,733,547 A * 3/1988 Honda
5,112,358 A * 5/1992 Deal, III
5,167,722 A * 12/1992 Pastryk et al.
5,443,655 A * 8/1995 Stover et al.
5,689,846 A * 11/1997 Cheyne et al.
5,692,259 A * 12/1997 Lee et al.
5,737,790 A * 4/1998 Badger et al.
5,743,115 A * 4/1998 Hashimoto
5,987,679 A * 11/1999 Won

FOREIGN PATENT DOCUMENTS

JP 54-69262 * 6/1979 ..... 68/12.05
JP 61-1645594 * 7/1986 ..... 68/12

* cited by examiner

*Primary Examiner*—Frankie L. Stinson
(74) *Attorney, Agent, or Firm*—Townsend and Townsend and Crew LLP

(57) ABSTRACT

A washing machine includes a water supply valve for supplying water to a washing drum when activated, and for cutting off supply of the water to the washing drum when deactivated. A first water level sensor is operable so as to set a first desired water level inside the washing drum and so as to generate a first control signal when the water inside the washing drum reaches the first desired water level. A second water level sensor is operable so as to set a second desired water level inside the washing drum and so as to generate a second control signal when the water inside the washing drum reaches the second desired water level. A control unit activates the water supply valve at the start of first and second washing cycles of a washing operation The control unit deactivates the water supply valve upon receiving the first control signal from the first water level sensor during the first washing cycle, and upon receiving the second control signal from the second water level sensor during the second washing cycle. As such, water can be conserved while ensuring effective washing of clothes and the presence of minimal detergent residue on the clothes.

3 Claims, 3 Drawing Sheets

WASHING MACHINE ADAPTED TO BE SUPPLIED WITH DIFFERENT LEVELS OF WATER DURING A WASHING OPERATION

BACKGROUND OF THE INVENTION

1. Field of the Invention

The invention relates to a washing machine, more particularly to a washing machine that is adapted to be supplied with different levels of water during a washing operation.

2. Description of the Related Art

Referring to FIGS. 1, 2 and 3, in a conventional washing machine 1, a washing operation (T) consists of first, second and third washing cycles. Each of the washing cycles includes a rinsing operation, a draining operation and a spinning operation. The conventional washing machine 1 includes a washing drum 11, a water level sensor 13 that is operable so as to set a desired water level inside the washing drum 11, and a water pipe 111 connected to the water level sensor 13 and the washing drum 11 to enable the water level sensor 13 to detect the water level inside the washing drum 11. When the washing operation (T) is initiated, a control unit 16 activates the water level sensor 13 and a water supply valve 14 to enable water flow into the washing drum 11. Upon detection by the water level sensor 13 that the water level inside the washing drum 11 has reached the desired water level, the water level sensor 13 generates a control signal that is received by the control unit 16. At this time, the control unit 16 deactivates the water supply valve 14 to cut-off the water flow into the washing drum 11, and activates a motor apparatus 17 for continuing with the rinsing operation of the first washing cycle. At the end of the rinsing operation, the control unit 16 activates a water drain valve 15 to drain the water inside the washing drum 11 during the draining operation. The spinning operation is started immediately after the draining operation. The above steps are repeated for the second washing cycle, which follows the first washing cycle, and the third washing cycle, which follows the second washing cycle.

In the conventional washing machine 1, only one water level sensor 13 is used to control the water level inside the washing drum 11 during the rinsing operation of each of the washing cycles. As such, the water level inside the washing drum 11 is uniform during the rinsing operation of the first, second and third washing cycles of the washing operation (T).

The aforesaid arrangement of the conventional washing machine 1, however, results in the following drawbacks: During the rinsing operation of the first washing cycle, a smaller amount of water is required so as to ensure an adequate detergent concentration and agitating force for effective removal of dirt from clothes. During the rinsing operation of the second and third washing cycles, a larger amount of water is required so as to minimize the presence of detergent residue on the clothes. In other words, the presence of a relatively large amount of water inside the washing drum during the rinsing operation of the first washing cycle results in waste of water resources and ineffective washing of the clothes. On the other hand, the presence of a relatively small amount of water inside the washing drum during the rinsing operations of the second and third washing cycles will result in a large amount of detergent residue on the clothes. It is thus desirable to provide a washing machine that is adapted to be supplied with different levels of water during the different washing cycles of a washing operation to conserve water while ensuring effective washing of clothes and the presence of minimal detergent residue on the clothes.

While it is possible to operate the water level sensor of the conventional washing machine so as to set different water levels during the rinsing operation of the different washing cycles, this requires manual supervision of the conventional washing machine during the washing operation.

SUMMARY OF THE INVENTION

Therefore, the object of the present invention is to provide a washing machine that is adapted to be supplied with different levels of water during a washing operation and that dispenses with the need for manual supervision during the washing operation.

According to the present invention, a washing machine comprises: a washing drum; water supply valve means for supplying water to the washing drum when activated, and for cutting off supply of the water to the washing drum when deactivated; a first water level sensor operable so as to set a first desired water level inside the washing drum and so as to generate a first control signal when the water inside the washing drum reaches the first desired water level; a second water level sensor operable so as to set a second desired water level inside the washing drum and so as to generate a second control signal when the water inside the washing drum reaches the second desired water level; and a control unit connected to the water supply valve means and the first and second water level sensors. The control unit activates the water supply valve means at the start of first and second washing cycles of a washing operation. The control unit deactivates the water supply valve means upon receiving the first control signal from the first water level sensor during the first washing cycle, and upon receiving the second control signal from the second water level sensor during the second washing cycle.

In the preferred embodiment, the control unit further activates the water supply valve means at the start of a third washing cycle of the washing operation, and further deactivates the water supply valve means upon receiving the second control signal from the second water level sensor during the third washing cycle.

Preferably, the second desired water level is higher than the first desired water level.

The washing machine of this invention permits conservation of water while ensuring effective washing of clothes and the presence of minimal detergent residue on the clothes.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
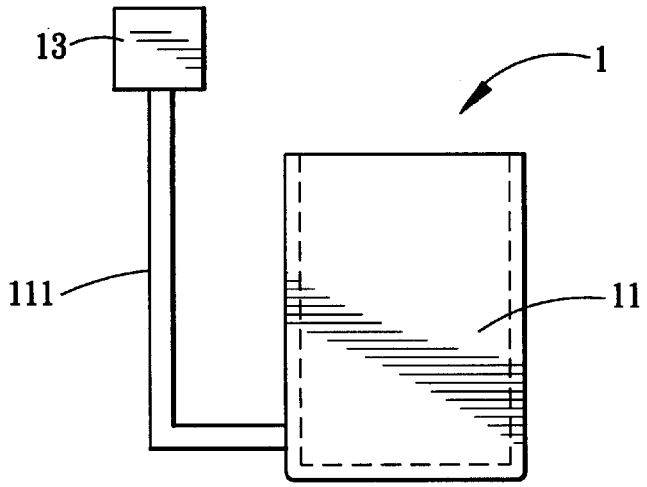
FIG.1 PRIOR ART
FIG. 1 is a schematic view showing a conventional washing machine.
Figure 2:
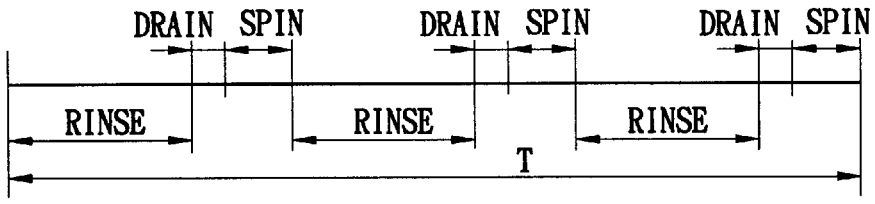
FIG.2 PRIOR ART
FIG. 2 is a timing diagram illustrating a washing operation of the conventional washing machine.
Figure 3:
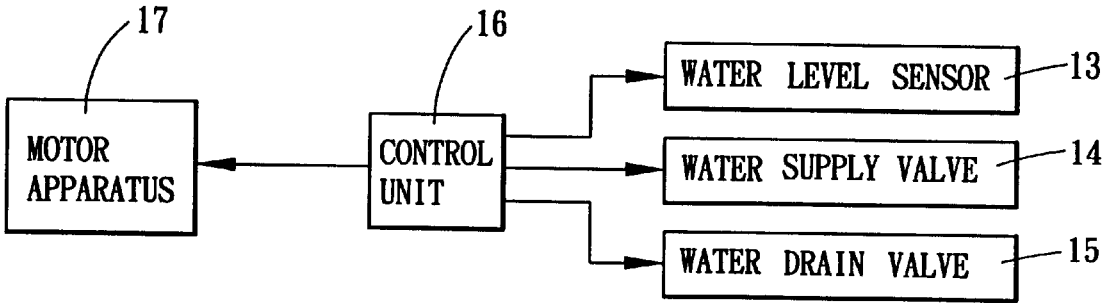
FIG.3 PRIOR ART
FIG. 3 is a schematic circuit block diagram of the conventional washing machine.
Figure 4:
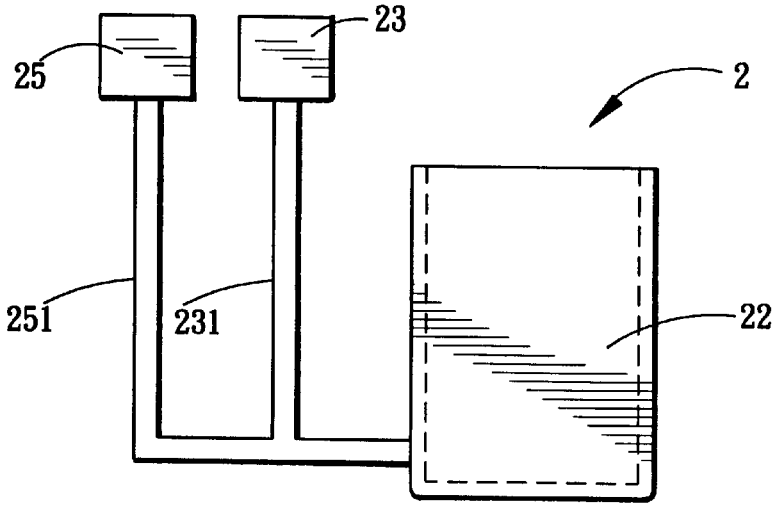
FIG. 4 is a schematic view showing the preferred embodiment of a washing machine according to this invention.
Figure 5:
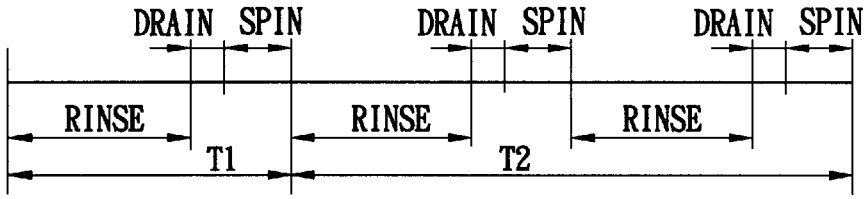
FIG. 5 is a timing diagram illustrating a washing operation of the preferred embodiment.
Figure 6:
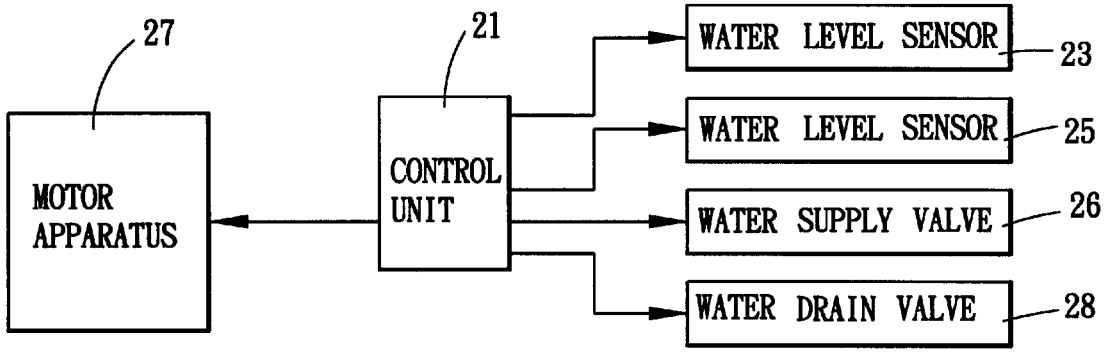
FIG. 6 is a schematic circuit block diagram of the preferred embodiment.

Referring to FIGS. 4, 5 and 6, the preferred embodiment of a washing machine 2 according to the present invention is shown to comprise a washing drum 22, a control unit 21, a motor apparatus 27 for driving the washing drum 22, at least two water level sensors 23, 25, a water supply valve 26, and a water drain valve 28.

Each of the water level sensors 23, 25 is connected to the washing drum 22 via a respective water pipe 231, 251 so as to permit detection of the water level inside the washing drum 22. Each of the water level sensors 23, 25 is operable with the use of function keys (not shown) so as to set a desired water level in the washing drum 22, and so as to generate a control signal when the water inside the washing drum 22 reaches the corresponding desired water level. In the preferred embodiment, the water level sensor 23 is used to control the water level inside the washing drum 22 during a time (T1) of a washing operation, whereas the water level sensor 25 is used to control the water level inside the washing drum 22 during a time (T2) of the washing operation. The time (T1) is the duration of the first washing cycle of the washing operation, while the time (T2) is the duration of the second and third washing cycles of the washing operation. Each of the washing cycles includes a rinsing operation, a draining operation and a spinning operation. At the start of the rinsing operation of each of the washing cycles, the control unit 21 activates the water supply valve 26 so as to supply water into the washing drum 22. During the first washing cycle, when the control unit 21 receives the control signal from the first water level sensor 23, indicating that the water level inside the washing drum 22 has reached the corresponding desired water level, the control unit 21 deactivates the water supply valve 26 so as to cut-off the supply of water into the washing drum 22. The control unit 21 subsequently activates the motor apparatus 27 for continuing with the rinsing operation of the first washing cycle. At the end of the rinsing operation, the control unit 21 activates the water drain valve 28 to drain the water inside the washing drum 22 during the draining operation. The spinning operation is started immediately after the draining operation. During the second and third washing cycles, when the control unit 21 receives the control signal from the second water level sensor 25, indicating that the water level inside the washing drum 22 has reached the corresponding desired water level, the control unit 21 deactivates the water supply valve 26 so as to cut-off the supply of water into the washing drum 22. The control unit 21 subsequently activates the motor apparatus 27 for continuing with the rinsing operation of the second or third washing cycle. The draining and spinning operations proceed under the control of the control unit 21 thereafter.

In the washing machine 2 of the present invention, at least two water level sensors 23, 25 are in use to control the water level inside the washing drum 22 during the first, second and third washing cycles of the washing operation. The water level inside the washing drum 22 can thus differ during the time (T1) and the time (T2) of the washing operation. Therefore, a lower desired water level can be set during the time (T1), i.e. the first washing cycle, so as to ensure an adequate detergent concentration and agitating force for effective removal of dirt from clothes. Whereas, a higher desired water level can be set during the time (T2), i.e. the second and third washing cycles, so as to minimize the presence of detergent residue on the clothes. The washing machine 2 of this invention is thus adapted to be supplied with different levels of water during the different washing cycles of a washing operation without the need for manual supervision thereof, thereby conserving water while ensuring effective washing of clothes and the presence of minimal detergent residue on the clothes. The object of the present invention is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A washing machine comprising:

a washing drum;

water supply valve means for supplying water to said washing drum when activated, and for cutting off supply of the water to said washing drum when deactivated;

a first water level sensor operable so as to set a first desired water level inside said washing drum and so as to generate a first control signal when the water inside said washing drum reaches the first desired water level;

a second water level sensor operable so as to set a second desired water level inside said washing drum and so as to generate a second control signal when the water inside said washing drum reaches the second desired water level; and a control unit connected to said water supply valve means and said first and second water level sensors, said control unit activating said water supply valve means at the start of first and second washing cycles of a washing operation, said control unit deactivating said water supply valve means upon receiving the first control signal from said first water level sensor during the first washing cycle, and upon receiving the second control signal from said second water level sensor during the second washing cycle.

2. The washing machine of claim 1, wherein said control unit further activates said water supply valve means at the start of a third washing cycle of the washing operation, and further deactivates said water supply valve means upon receiving the second control signal from said second water level sensor during the third washing cycle.

3. The washing machine of claim 1, wherein the second desired water level is higher than the first desired water level.

* * * * *